US008910533B2

(12) United States Patent
Maki, Jr.

(10) Patent No.: US 8,910,533 B2
(45) Date of Patent: Dec. 16, 2014

(54) METHOD FOR PRESSURE COMPENSATING A TRANSDUCER

(75) Inventor: Voldi E. Maki, Jr., Austin, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/820,426

(22) PCT Filed: Apr. 11, 2011

(86) PCT No.: PCT/US2011/031963
§ 371 (c)(1),
(2), (4) Date: Mar. 1, 2013

(87) PCT Pub. No.: WO2012/141681
PCT Pub. Date: Oct. 18, 2012

(65) Prior Publication Data
US 2013/0160539 A1 Jun. 27, 2013

(51) Int. Cl.
*G01D 21/00* (2006.01)
*E21B 47/01* (2012.01)

(52) U.S. Cl.
CPC ..... *E21B 47/01* (2013.01); *E21B 47/011* (2013.01)
USPC ..... 73/866.5

(58) Field of Classification Search
USPC ..... 73/866.5
See application file for complete search history.

(56) References Cited

U.S. PATENT DOCUMENTS

| | | | |
|---|---|---|---|
| 4,241,611 | A | 12/1980 | Specht et al. |
| 5,044,462 | A | 9/1991 | Maki, Jr. |
| 6,213,250 | B1 | 4/2001 | Wisniewski |
| 7,587,936 | B2 | 9/2009 | Han |
| 2010/0020638 | A1 | 1/2010 | Mickael et al. |
| 2010/0147083 | A1 | 6/2010 | Tan et al. |

FOREIGN PATENT DOCUMENTS

| | | | |
|---|---|---|---|
| EP | 1903181 | A1 | 3/2008 |
| GB | 2168569 | A | 6/1986 |
| GB | 2242462 | A | 2/1991 |
| WO | WO-2012141681 | A1 | 10/2012 |

OTHER PUBLICATIONS

"International Application Serial No. PCT/US2011/031963, International Search Report mailed Jan. 19, 2012", 5 pgs.
"International Application Serial No. PCT/US2011/031963, Written Opinion mailed Jan. 19, 2012", 6 pgs.
"International Application Serial No. PCT/US2011/031963, International Preliminary Report on Patentability mailed Oct. 24, 2013", 7 pgs.

*Primary Examiner* — Hezron E. Williams
*Assistant Examiner* — Rodney T Frank
(74) *Attorney, Agent, or Firm* — Schwegman Lundberg & Woessner, P.A.; Benjamin Fite

(57) ABSTRACT

Various embodiments include apparatus and methods of providing a sensor, in a transducer subassembly, having a backing (1) coupled to a housing (7) without bonding the sensor to the housing such that the sensor is effectively mechanically decoupled from the housing except for longitudinal waves traveling through the front face of the transducer subassembly. Additional apparatus, systems, and methods are disclosed.

19 Claims, 5 Drawing Sheets

METHOD FOR PRESSURE COMPENSATING A TRANSDUCER

RELATED APPLICATIONS

This application is an U.S. National Stage Filing under 35 U.S.C. 371 from International Application No. PCT/US2011/031963, filed on 11 Apr. 2011, and published as WO 2012/141681 A1 on 18 Oct. 2012, which application and publication are incorporated herein by reference in their entirety.

TECHNICAL FIELD

The present invention relates generally to apparatus for making measurements related to oil and gas exploration.

BACKGROUND

In drilling wells for oil and gas exploration, understanding the structure and properties of the associated geological formation provides information to aid such exploration. Measurements in a borehole are typically performed to attain this understanding. However, the pressure and temperatures accompanying measurement tools in the borehole of a well can affect operation of these tools in the borehole. The usefulness of such measurements may be related to the precision or quality of the information derived from such measurements.

DETAILED DESCRIPTION

The following detailed description refers to the accompanying drawings that show, by way of illustration and not limitation, various embodiments in which the invention may be practiced. These embodiments are described in sufficient detail to enable those skilled in the art to practice these and other embodiments. Other embodiments may be utilized, and structural, logical, and electrical changes may be made to these embodiments. The various embodiments are not necessarily mutually exclusive, as some embodiments can be combined with one or more other embodiments to form new embodiments. The following detailed description is, therefore, not to be taken in a limiting sense.

In various embodiments, hydrostatic pressure and temperature related stress can be decoupled from a sensor contained within a housing with different structural properties. The housing can be structured to operate at pressures and temperatures associated with drilling in a borehole. In an example operation in the borehole, the front face of the sensor is exposed to the borehole fluid and the hydrostatic pressure in the well. The back and interior of the transducer is exposed to a pressure compensating oil that is at approximately the same pressure as the borehole fluid. A sensor can be constructed having a backing coupled to a housing without bonding the sensor to the housing such that the sensor is effectively mechanically decoupled from the housing except for longitudinal waves traveling through the front face of a transducer subassembly.

The sensor, which can be realized as a piezoelectric material, can be decoupled from the housing on the edges of the sensor as well as on the face of the sensor using a very thin layer of oil to interface between the sensor and the housing. The path for the oil to migrate between the sensor and the housing can be formed using tape in one or more locations. In addition, the contact surface between the sensor and the housing can be made to approach an optically flat surface to minimize the oil layer thickness, where good acoustic coupling is desired. For a piezoelectric sensor, the contact surface between the sensor and the housing can be made to approach an optically flat surface to also minimize its effect on an acoustic signal.

Figure 1:
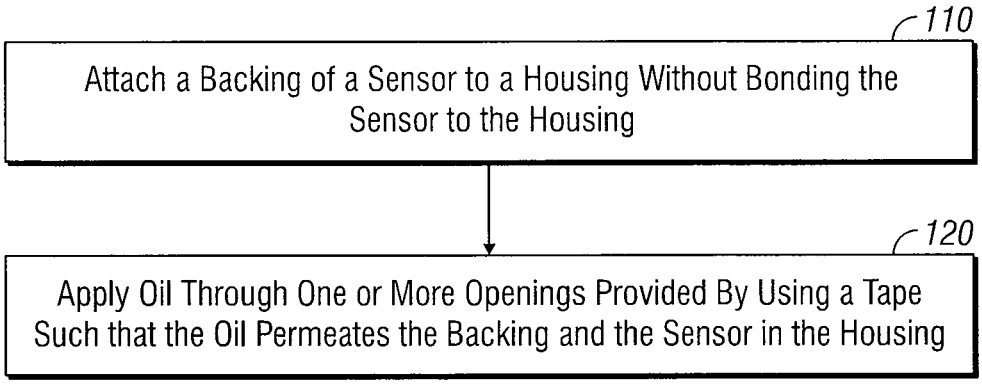
FIG. 1 shows features of an example method of forming a transducer subassembly in a housing, in accordance with various embodiments.

FIG. 1 shows features of an embodiment of a method of forming a transducer subassembly in a housing. The housing can be structured to operate at pressures and temperatures associated with drilling in a borehole. Oil pathways to a sensor in the transducer subassembly can be created using removable tape. A backing of the sensor can be bonded to the housing using epoxy. A tape can be used to centralize the backing in the housing before the epoxy cures. The tape can be removed to form the oil passageway after the epoxy cures. The sensor can be realized as a piezoelectric material and the housing can be a housing of polyether ether ketone. Polyether ether ketone, commonly referred to as PEEK, is an organic polymer thermoplastic. The piezoelectric material in the transducer subassembly can be a ceramic. The removable tape can be Teflon tape. Other materials may be used for the sensor, the housing, the tape, or combinations thereof.

At 110, a backing of a sensor is attached to the housing without bonding the sensor to the housing. The backing can be bonded to the sensor. Attaching the backing to the housing can include using an epoxy to bond the backing to the housing. Alternatively, the sensor and backing can be confined in the housing using a wave spring to maintain constant pressure at an interface of a face of the sensor and an interior surface of the housing. The material for the backing can be selected having sufficient softness and being compliant such that the backing does not produce stresses in the piezoelectric material that cause the piezoelectric material to behave differently at high temperatures and high pressures due to dimensional changes of the backing.

At 120, oil can be applied through one or more openings provided by using a tape such that the oil permeates the backing and the sensor in the housing. A pressure compensating oil can be used. In coupling the sensor with the housing such that the sensor is not bonded to the housing, the sensor can be decoupled from the housing except for coupling of the sensor to the housing by the oil and the backing. A sensor configured as a piezoelectric material having a surface ground optically flat can be positioned adjacent to an interior surface of the housing. With the interior surface ground or machined optically flat, the optically flat surface of the sensor can be separated from the interior surface by the oil having minimal thickness.

In various embodiments, the method of forming a transducer subassembly in a housing can include bonding the backing to the sensor to form a transducer subassembly, applying the tape to the transducer subassembly, utilizing the tape to centralize the transducer subassembly in the housing, and removing the tape after the backing is bonded to the housing such that removing the tape provides slots for portions of the oil to reach the sensor. Pressure can be applied to the transducer subassembly as the backing is bonded to the housing such that the sensor is maintained in functional contact with the housing. In constructing the transducer subassembly in a housing, electrical conductors can be coupled to electrodes on a surface of the piezoelectric material through grooves cut in the backing.

In various embodiments, a piezoelectric element, such as a ceramic, and a backing to the piezoelectric element can be enclosed in a PEEK housing for environmental protection. Such environmental protection provides for operation of the piezoelectric element as a sensor to operate at pressures and temperatures associated with drilling in a borehole. The housing can be realized as a polyether ether ketone housing. Optionally, an intermediate matching layer can be configured in the housing with the piezoelectric element and backing. The piezoelectric element and the backing can be bonded together and the backing can be bonded to the housing for mechanical stability, where the piezoelectric element is not bonded to the housing. Pressure compensation oil can be allowed to permeate the backing and the piezoelectric material in the housing.

Figure 2:
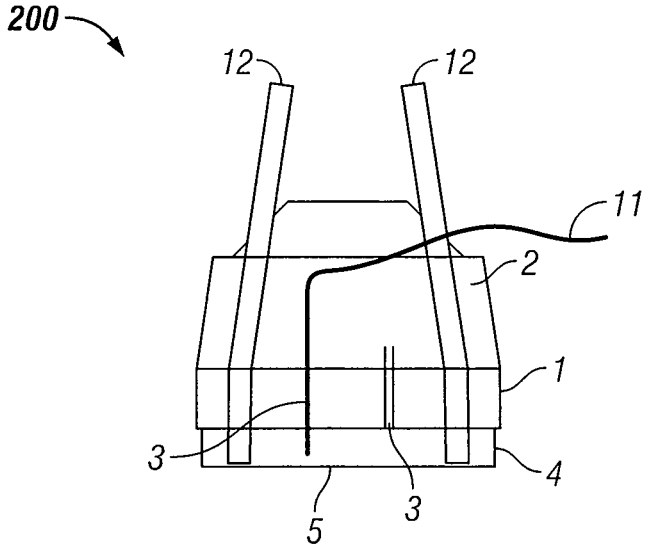
FIG. 2 shows an example of a transducer subassembly arranged for positioning in a housing, in accordance with various embodiments.
Figure 3:
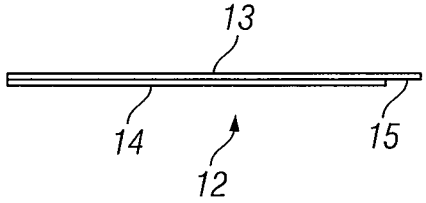
FIG. 3 shows an example of a tape structured to have two layers for use in the transducer subassembly of FIG. 2, in accordance with various embodiments.

FIG. 2 shows an embodiment of a transducer subassembly 200. Transducer subassembly 200 includes a piezoelectric element 4 bonded to a backing 1. Optionally, an intermediate matching layer 2 can be configured with the piezoelectric element 4 and backing 1. Backing 1 can be selected to have a high acoustic attenuation and acoustic impedance matching that of piezoelectric element 4. Backing 1 has small grooves 3 cut in several places to allow for electrical conductors 11 to pass. The conductors can be attached to electrodes on a surface 5 of piezoelectric element 4. Transducer subassembly 200 can also have several tapes 12 that are to be utilized to construct transducer subassembly 200 in a housing. For example, transducer subassembly 200 can include three or more strips of tape attached. These strips of tape can, typically, be Teflon tape. Tape 12 can be structured to have two layers 13 and 14 connected together as shown in FIG. 3. One layer, for example layer 14, is shorter than the other layer allowing for one end 15 of the longer tape, layer 13 for example, to be attached to piezoelectric element 4. The front surface of piezoelectric element 4 can be ground to a fine finish so as to appear optically flat.

Figure 4:
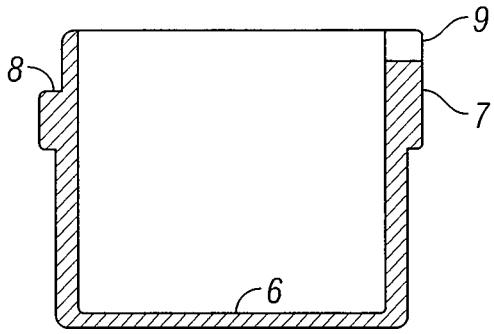
FIG. 4 shows an example of a housing in which the transducer subassembly of FIG. 2 can be positioned, in accordance with various embodiments.

FIG. 4 shows an embodiment of a housing 7 in which transducer subassembly 200 of FIG. 2 can be positioned. Housing 7 can be realized as a PEEK housing. Other materials appropriate for the pressures and temperatures associated with drilling operations in a borehole can be used. Housing 7 has a side 8 and an interior surface 6, which will be placed in contact with face 5 of piezoelectric element 4. Similar to piezoelectric element 4, interior surface 6 can also be constructed as flat as possible. Such construction can be performed by appropriately machining interior surface 6. Machining interior surface 6 can be performed to a fine finish approaching an optically flat surface. Housing 7 also includes opening 9 in which electrical connectors can be provided to the interior of housing 7.

Transducer subassembly 200 of FIG. 2 can be assembled into housing 7 of FIG. 4 utilizing the taped areas 12 to centralize transducer subassembly 200 in housing 7. Electrical conductors 11 are located so as to pass through opening 9 in housing 7. Pressure can be applied to the transducer subassembly 200 to maintain contact of piezoelectric element 4 with housing 7 as epoxy is used to bond backing 1 to housing 7. The epoxy can also stabilize the wires in the transducer.

After the epoxy is set, the tape sections 12 can be pulled from the assembly. The slots formed by removing tapes 12 allow pressure compensating oil to reach piezoelectric element 4 and fill the voids from the removed tapes 12.

Figure 5:
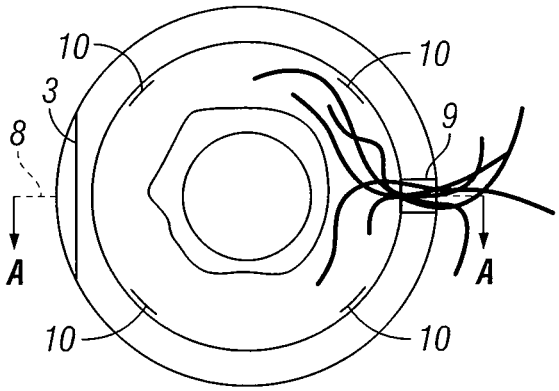
FIG. 5 shows a top view of the transducer subassembly of FIG. 2 positioned in housing of FIG. 4, in accordance with various embodiments.

FIG. 5 shows a top view of transducer subassembly 200 of FIG. 2 in housing 7 of FIG. 4. Pathways 10 are provided with the removal of tapes 12, where the pathways 10 provide a mechanism to provide pressure compensating oil to face 5 of piezoelectric element 4 disposed adjacent interior surface 6 of housing 7. Grooves 3, in backing 1, to allow for electrical conductors to pass to piezoelectric element 4 and opening 9, in side 8, to allow electrical conductors to enter housing 7 are also shown.

Figure 6:
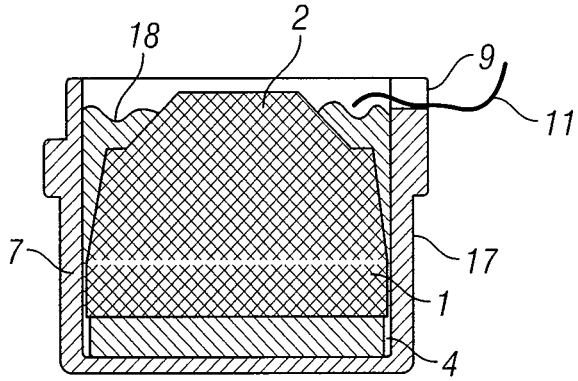
FIG. 6 shows an example of a completed tool having a sensor arranged in a protective housing relative to FIGS. 2-5, in accordance with various embodiments.

FIG. 6 shows an embodiment of a completed transducer 17 having a sensor arranged in a protective housing. Transducer 17 includes housing 7 with piezoelectric element 4 bonded to backing 1 disposed in housing 7. Backing 1 is bonded to housing 7 with epoxy 18 without bonding piezoelectric element 4 to housing 7. Electrical conductors 11 are provided to transducer 17 through openings 9 in housing 7. Transducer 17 can optionally include intermediate matching layer 2.

Figure 7:
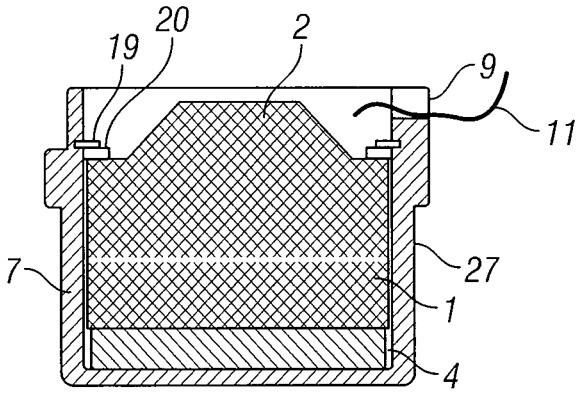
FIG. 7 shows another example of a completed tool having a sensor arranged in a protective housing relative to FIGS. 2-5, in accordance with various embodiments.

FIG. 7 shows another embodiment of a completed transducer 27 having a sensor arranged in a protective housing. A transducer subassembly, such as transducer subassembly 200 of FIG. 2, may be confined in a housing, such as housing 7 of FIG. 4, using a snap ring 19 in housing 7 and a wave spring 20 pressing on the backing material, either directly on backing 1 or on intermediate matching layer 2 on backing 1, in the transducer subassembly. The wave spring assembly may provide moderate constant pressure to maintain good acoustic contact at the face of the piezoelectric element 4 without bonding piezoelectric element 4 to housing 7. Housing 7 of competed tool 27 includes openings 9 in which electrical conductors can be provided to the interior of housing 7. Making a piezoelectric slightly smaller, for example by approximately 0.005 inches, reduces acoustic coupling of the ceramic to a PEEK housing, in which it is configured, and reduces coupling of mechanical stress from the PEEK housing to the ceramic. Not bonding the face of the piezoelectric to the PEEK housing can greatly reduce the shear stress in the piezoelectric due to differences in the response to heating or applying pressure to the various materials. The interface of the piezoelectric ceramic to the PEEK housing can be constructed to be very thin, for example less than approximately 0.001 inches. At higher thickness of the interface, the acoustic performance of the piezoelectric can be affected. As a result, surface characteristics of the two materials can be critical to optimum acoustic performance.

To attain a thin interface between a sensor and a housing, the mating surfaces are manufactured as flat and smooth as possible. The path for oil to migrate into a transducer assembly in a housing can be formed using a tape, such as Teflon tape, in several locations. The sensor, such as a ceramic piezoelectric, can be decoupled from its housing, such as a Peek housing, on the edges as well as on the face of the sensor except for a very thin layer of oil. The contact surface between the piezoelectric and the PEEK can be made as close as reasonable to optically flat to minimize the oil layer thickness and its effect on the acoustic signal. A wave spring can be used to maintain constant pressure on interface of the piezoelectric to the PEEK housing.

The process of mating a sensor to its housing using a tape to form oil passageways without bonding the sensor to the housing can provide better signal stability with variations of temperature and pressure than previous designs. Lower construction costs may also be attainable.

Figure 8:
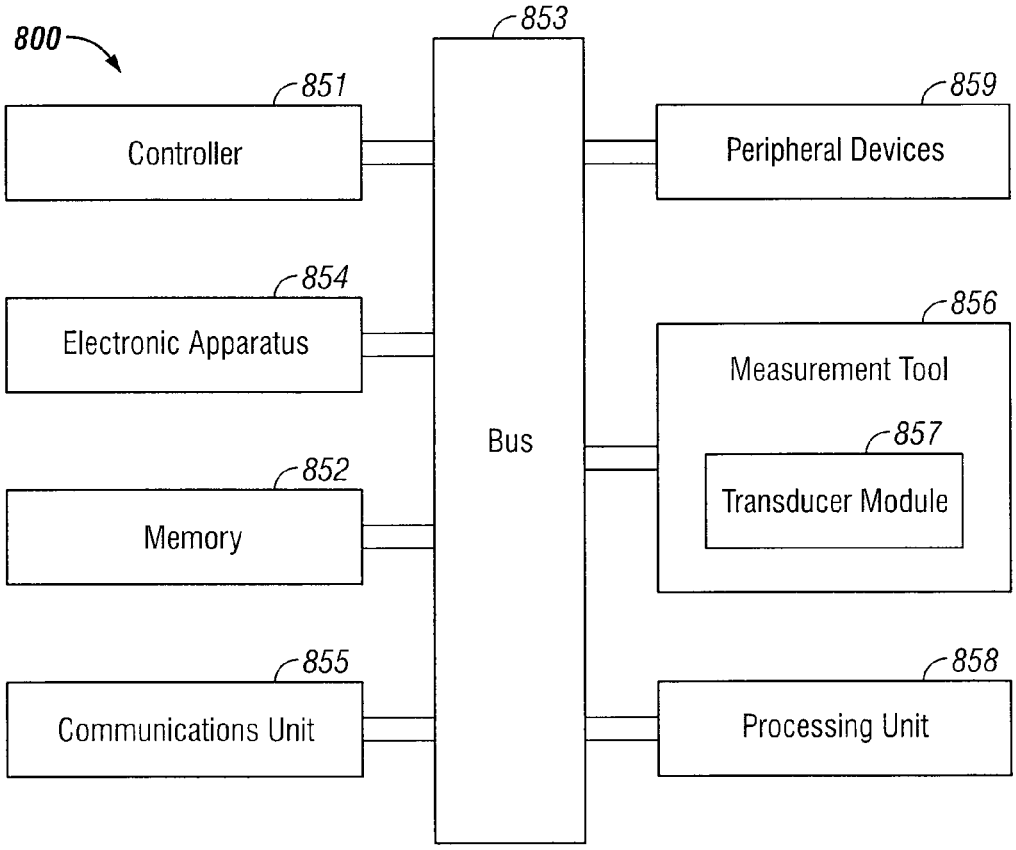
FIG. 8 depicts a block diagram of features of an example system having a tool including a transducer module, in accordance with various embodiments.

FIG. 8 depicts a block diagram of features of an example embodiment of a system 800 having a measurement tool 856 including a transducer module 857 for measurements downhole in a well. Transducer module 857 can be structured with a configuration such that the sensor of transducer module 857 is not bonded to the housing of transducer module 857. The sensor can be bonded to a backing, where the backing can be attached to the housing without the sensor bonded to the housing. Transducer module 857 can be realized as a focused ultrasonic transducer module. Transducer module 857 can be structured similar to or identical to a configuration associated with any of FIGS. 1-7.

System 800 can include a controller 851, a memory 852, an electronic apparatus 854, and a communications unit 855. Controller 851, memory 852, and communications unit 855 can be arranged to operate as a processing unit to control management of measurement tool 856 and to perform operations on data signals collected by measurement tool 856. A data processing unit can be distributed among the components of system 800 including electronic apparatus 854. Alternatively, system 800 can include a processing unit 858 to mange measurement tool 856.

Communications unit 855 can include downhole communications for communication to the surface at a well from measurement tool 856. Such downhole communications can include a telemetry system. Communications unit 855 may use combinations of wired communication technologies and wireless technologies at frequencies that do not interfere with on-going measurements.

System 800 can also include a bus 853, where bus 853 provides electrical conductivity among the components of system 800. Bus 853 can include an address bus, a data bus, and a control bus, each independently configured. Bus 853 can be realized using a number of different communication mediums that allows for the distribution of components of system 800. Use of bus 853 can be regulated by controller 851.

In various embodiments, peripheral devices 859 can include displays, additional storage memory, and/or other control devices that may operate in conjunction with controller 851 and/or memory 852. In an embodiment, controller 851 is realized as a processor or a group of processors that may operate independently depending on an assigned function. Peripheral devices 859 can be arranged with a display, as a distributed component on the surface, that can be used with instructions stored in memory 852 to implement a user interface to manage the operation of measurement tool 856 and/or components distributed within system 800. Such a user interface can be operated in conjunction with communications unit 855 and bus 853.

Figure 9:
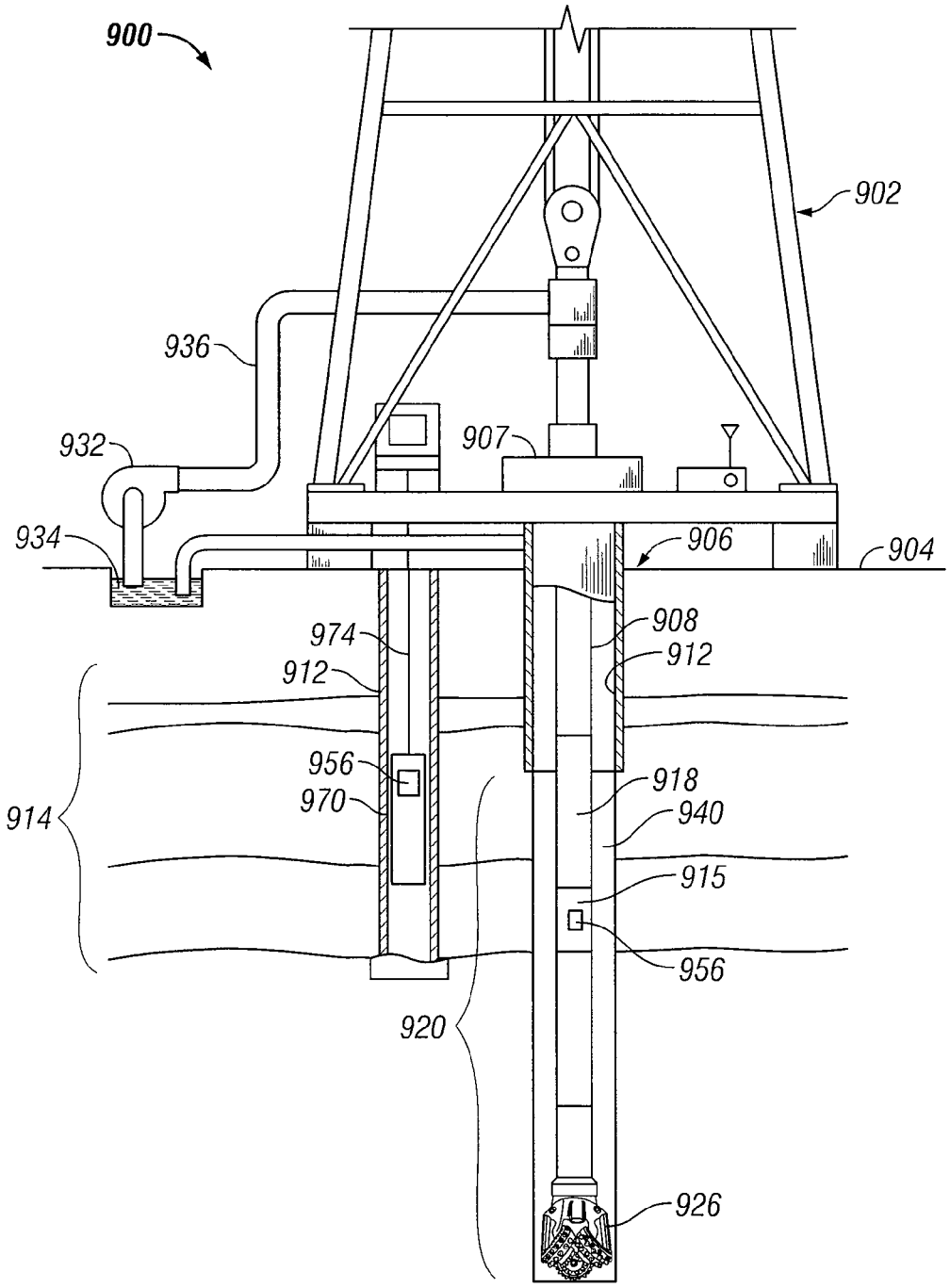
FIG. 9 depicts an example system at a drilling site, where the system includes a measurement tool having a transducer module, in accordance with various embodiments.

FIG. 9 depicts an embodiment of a system 900 at a drilling site, where system 900 includes a measurement tool 956 including a transducer module for measurements downhole in a well. Transducer module can be structured with a configuration such that the sensor of transducer module is not bonded to the housing of transducer module. The sensor can be bonded to a backing, where the backing can be attached to the housing without the sensor bonded to the housing. Transducer module can be realized as a focused ultrasonic transducer module. Measurement tool 956 can be structured and fabricated in accordance with various embodiments as taught herein with respect to a sensor tool including a transducer module, such as a focused ultrasonic transducer module.

System 900 can include a drilling rig 902 located at a surface 904 of a well 906 and a string of drill pipes, that is, drill string 908, connected together so as to form a drilling string that is lowered through a rotary table 907 into a wellbore or borehole 912. The drilling rig 902 can provide support for drill string 908. The drill string 908 can operate to penetrate rotary table 907 for drilling a borehole 912 through subsurface formations 914. The drill string 908 can include drill pipe 918 and a bottom hole assembly 920 located at the lower portion of the drill pipe 918.

The bottom hole assembly 920 can include drill collar 915, measurement tool 956 attached to drill collar 915, and a drill bit 926. The drill bit 926 can operate to create a borehole 912 by penetrating the surface 904 and subsurface formations 914. Measurement tool 956 can be structured for an implementation in the borehole of a well as a MWD system such as a LWD system. The housing containing measurement tool 956 can include electronics to manage measurement tool 956 and collect responses from measurement tool 956. Such electronics can include a processing unit to analyze signals sensed by measurement tool 956 and provide measurement results to the surface over a standard communication mechanism for operating a well. Alternatively, the electronics can include a communications interface to provide signals sensed by measurement tool 956 to the surface over a standard communication mechanism for operating a well, where these sensed signals can be analyzed at a processing unit at the surface.

In various embodiments, measurement tool 956 may be included in a tool body 970 coupled to a logging cable 974 such as, for example, for wireline applications. Tool body 970 containing measurement tool 956 can include electronics to manage measurement tool 956 and collect responses from measurement tool 956. Such electronics can include a processing unit to analyze signals sensed by measurement tool 956 and provide measurement results to the surface over a standard communication mechanism for operating a well. Alternatively, the electronics can include a communications interface to provide signals sensed by measurement tool 956 to the surface over a standard communication mechanism for operating a well, where these collected sensed signals are analyzed at a processing unit at the surface. Logging cable 974 may be realized as a wireline (multiple power and communication lines), a mono-cable (a single conductor), and/or a slick-line (no conductors for power or communications), or other appropriate structure for use in bore hole 912.

During drilling operations, the drill string 908 can be rotated by the rotary table 907. In addition to, or alternatively, the bottom hole assembly 920 can also be rotated by a motor (e.g., a mud motor) that is located downhole. The drill collars 915 can be used to add weight to the drill bit 926. The drill collars 915 also can stiffen the bottom hole assembly 920 to allow the bottom hole assembly 920 to transfer the added weight to the drill bit 926, and in turn, assist the drill bit 926 in penetrating the surface 904 and subsurface formations 914.

During drilling operations, a mud pump 932 can pump drilling fluid (sometimes known by those of skill in the art as "drilling mud") from a mud pit 934 through a hose 936 into the drill pipe 918 and down to the drill bit 926. The drilling fluid can flow out from the drill bit 926 and be returned to the surface 904 through an annular area 940 between the drill pipe 918 and the sides of the borehole 912. The drilling fluid may then be returned to the mud pit 934, where such fluid is filtered. In some embodiments, the drilling fluid can be used to cool the drill bit 926, as well as to provide lubrication for the drill bit 926 during drilling operations. Additionally, the drilling fluid may be used to remove subsurface formation 914 cuttings created by operating the drill bit 926.

Although specific embodiments have been illustrated and described herein, it will be appreciated by those of ordinary skill in the art that any arrangement that is calculated to achieve the same purpose may be substituted for the specific embodiments shown. Various embodiments use permutations and/or combinations of embodiments described herein. It is to be understood that the above description is intended to be illustrative, and not restrictive, and that the, phraseology or terminology employed herein is for the purpose of description. Combinations of the above embodiments and other embodiments will be apparent to those of skill in the art upon studying the above description.

What is claimed is:

1. A method comprising:

attaching a backing of a sensor to a housing without bonding the sensor to the housing, the housing structured to operate at pressures and temperatures associated with drilling in a borehole; and applying oil through one or more openings provided by using a tape such that the oil permeates the backing and the sensor in the housing, wherein the sensor is decoupled from the housing except for coupling of the sensor to the housing by the oil and the backing, the oil being pressure compensating oil.

2. The method of claim 1, wherein the method includes confining the sensor and backing in the housing using a wave spring to maintain constant pressure at an interface of a face of the sensor and an interior surface of the housing.

3. The method of claim 1, wherein the method includes:

bonding the backing to the sensor to form a transducer subassembly;

applying the tape to the transducer subassembly;

utilizing the tape to centralize the transducer subassembly in the housing;

removing the tape after attaching the backing to the housing such that removing the tape provides slots for portions of the oil to reach the sensor when the applying the oil is performed.

4. The method of claim 3, wherein pressure is applied to the transducer assembly as the backing is bonded to the housing such that the sensor is maintained in functional contact with the housing.

5. The method of claim 4, wherein the sensor includes a piezoelectric material.

6. The method of claim 5, wherein the housing includes a housing of polyether ether ketone.

7. The method of claim 6, wherein bonding the backing to the housing includes using an epoxy to bond the backing to the housing.

8. The method of claim 6, wherein the tape is a Teflon tape.

9. The method of claim 3, wherein the method includes coupling electrical conductors to electrodes on a surface of the piezoelectric material through grooves cut in the backing.

10. The method of claim 3, wherein the method includes using a piezoelectric material having a surface ground to an optically flat surface and positioning the optically flat surface adjacent to an interior surface of the housing.

11. The method of claim 10, wherein the method includes using a housing having its interior surface ground to an optically flat interior surface such that the optically flat surface of the sensor is separated from the interior surface by the oil having a minimized thickness.

12. An apparatus comprising:

a housing structured to operate at pressures and temperatures associated with drilling in a borehole;

a sensor bonded to a backing in a subassembly, the backing attached to the housing without the sensor bonded to the housing;

oil separating a surface of the sensor from an interior surface of the housing such that the sensor is decoupled from the housing except for coupling by the oil and the backing, the oil being pressure compensating oil, the oil having a thickness corresponding to access of the oil to the sensor provided by tape removed from the subassembly after the backing is bonded to the housing.

13. The apparatus of claim 12, wherein the apparatus includes a wave spring to maintain constant pressure at an interface of a face of the sensor and an interior surface of the housing.

14. The apparatus of claim 12, wherein the sensor includes a piezoelectric material.

15. The apparatus of claim 14, wherein the housing includes a housing of polyether ether ketone.

16. The apparatus of claim 14, wherein epoxy attaches the backing to the housing.

17. The apparatus of claim 14, wherein the backing includes grooves through which electrical conductors are coupled to electrodes on a surface of the piezoelectric material.

18. The apparatus of claim 14, wherein the piezoelectric material has an optically flat surface and the piezoelectric material is positioned such that the optically flat surface is adjacent to an interior surface of the housing.

19. The apparatus of claims 18, wherein the interior surface of the housing is an optically flat interior surface.

* * * * *